US006830732B1

(12) United States Patent
Hoffman et al.

(10) Patent No.: US 6,830,732 B1
(45) Date of Patent: Dec. 14, 2004

(54) MULTIWELL FILTRATION PLATE

(75) Inventors: Hans-Jürgen Hoffman, Köln (DE); Timo Hillebrand, Berlin (DE); Peter Bendzko, Berlin (DE)

(73) Assignees: Invitek GmbH, Berlin (DE); AHN Biotechnologie GmbH, Nordhause (DE)

( * ) Notice: Subject to any disclaimer, the term of this patent is extended or adjusted under 35 U.S.C. 154(b) by 0 days.

(21) Appl. No.: 09/702,099

(22) Filed: Oct. 30, 2000

(30) Foreign Application Priority Data

Aug. 2, 2000 (DE) ..... 100 41 825

(51) Int. Cl.[7] ..... B01L 3/00
(52) U.S. Cl. ..... 422/101; 422/102
(58) Field of Search ..... 422/101, 102, 422/104, 100; 435/288.6; 210/474, 477

(56) References Cited

U.S. PATENT DOCUMENTS 3,295,686 A * 1/1967 Krueger ..... 210/455
4,902,481 A 2/1990 Clark et al.
4,948,442 A 8/1990 Manns
4,948,564 A 8/1990 Root et al.
4,956,298 A * 9/1990 Diekmann ..... 210/772
5,085,781 A * 2/1992 Tsuru et al. ..... 210/290
5,096,575 A * 3/1992 Cosack ..... 210/238
5,108,704 A 4/1992 Bowers et al.
5,141,719 A 8/1992 Fernwood et al.
5,205,989 A * 4/1993 Aysta ..... 210/323.2
5,264,184 A * 11/1993 Aysta et al. ..... 210/473
5,283,039 A * 2/1994 Aysta ..... 211/74
5,368,729 A * 11/1994 Stefkovich et al. ..... 210/266
5,464,541 A * 11/1995 Aysta et al. ..... 210/406
RE35,267 E * 6/1996 Tsuru et al. ..... 210/692
5,595,653 A * 1/1997 Good et al. ..... 210/198.2
5,620,662 A 4/1997 Perlman
5,620,663 A * 4/1997 Aysta et al. ..... 210/473
5,792,430 A * 8/1998 Hamper ..... 422/102
5,846,493 A * 12/1998 Bankier et al. ..... 210/406
5,855,852 A * 1/1999 Bienhaus et al. ..... 422/100
5,888,831 A * 3/1999 Gautsch ..... 422/101
5,906,796 A * 5/1999 Blevins et al. ..... 422/102
6,027,694 A 2/2000 Boulton et al.
6,054,100 A * 4/2000 Stanchfield et al. ..... 422/101
6,159,368 A * 12/2000 Moring et al. ..... 210/258
6,183,645 B1 * 2/2001 DeWitt ..... 210/321.6
6,200,533 B1 * 3/2001 Blevins et al. ..... 422/102
6,338,802 B1 * 1/2002 Bodner et al. ..... 210/261
6,391,241 B1 5/2002 Cote et al.
2001/0001643 A1 * 5/2001 Simpson et al. ..... 422/101
2001/0001644 A1 * 5/2001 Coffman et al. ..... 422/102

FOREIGN PATENT DOCUMENTS

DE 3214287 A1 * 12/1982 ..... G01N/33/56
JP 02151769 A * 6/1990 ..... G01N/35/02

* cited by examiner

*Primary Examiner*—Jeffrey Snay
(74) *Attorney, Agent, or Firm*—Goodwin Procter, LLP

(57) ABSTRACT

The invention relates to a new multiwell filtration plate for high throughput applications in nucleic acid technology, preferably in a 96-well or 384-well format, consisting of two individual parts, which are firmly and tightly connected together. The upper part of the plate is a sample holder 1 for holding a sample to be filtered. The lower part of the plate is an outlet part with a filter insert for receiving a sample from the sample holder part and filtering the, sample through the filter insert.

5 Claims, 4 Drawing Sheets

A–A
127.4
125
0.03
96x
ø7+0.02
ø5
scharfkantig
4.8
1.9
6
37
1
1
ø7
122.6
123.4
125.6
R1
R1

1
E
C
99
B
9
8.5
8.5
R1
R1
D
9
45°
63
A
A
R1
R2.2
B
C
D–D
1
7.9
1.8
18
R1

MULTIWELL FILTRATION PLATE

FIELD OF INVENTION

The invention relates to a new multiwell filtration plate for high throughput applications in the nucleic acid technology, preferably in the 96-well or 384-well format.

BACKGROUND

In recent years, there has been an increasing trend towards automating the isolation and purification of nucleic acids. The reason for that is that biological methods are increasingly gaining acceptance in all research fields of modern biotechnology. Automation of the isolation and purification of plasma DNA has become an urgent prerequisite due to the DNA sequencing within the worldwide genome projects (for example, the human genome project). The need to develop automation variants is not limited only to the field of plasmid DNA isolation. The automated isolation of genomic DNA from different starting materials and amounts, as well as the isolation of RNA are increasingly gaining in importance. This involves all areas of basic molecular research and increasingly also the diagnostics area.

Methods of automated isolation of nucleic acids are realized at the present time by the use of microtest plates with built-in filter materials. Formats in use at the present time are so-called 96-well or 384-well microtest plates. However, presently available 96-well microtest plates with filter material are extremely expensive for high-throughput applications. This results from the relatively complicated manufacturing methods for bringing the filter material into the microtest plates such as described in U.S. Pat. No. 4,948,442. Moreover, none of the previously known microtest plates with filter insert realize sufficient protection against cross contamination of samples when used for the isolation and purification of nucleic acids. The reason for this is the much too short outlet 30 connecting piece at the bottom of the multiwell filtration plate.

A further problem is posed by the small capacity of the reaction cavities, such as those described in European patent No. 0,098,534.

BRIEF DESCRIPTIONS OF THE INVENTION

It is an object of the invention to provide a multiwell filtration plate for nucleic acid technology, which is particularly suitable also for high throughput applications, provides protection against cross contamination of the samples and can be produced relatively inexpensively.

Another object is a method for producing the multiwell filtration plates of the present invention. The new multiwell filtration plate of the present invention has two individual parts, which are tightly connected with one another. A first part is a sample holder and the second part acts as an outlet part after filtration is completed.

BRIEF DESCRIPTION OF THE DRAWING

The invention is disclosed below in greater detail, with reference being had to the drawing, wherein.

DETAILED DESCRIPTION

Figures 1A, 1B, 1C:
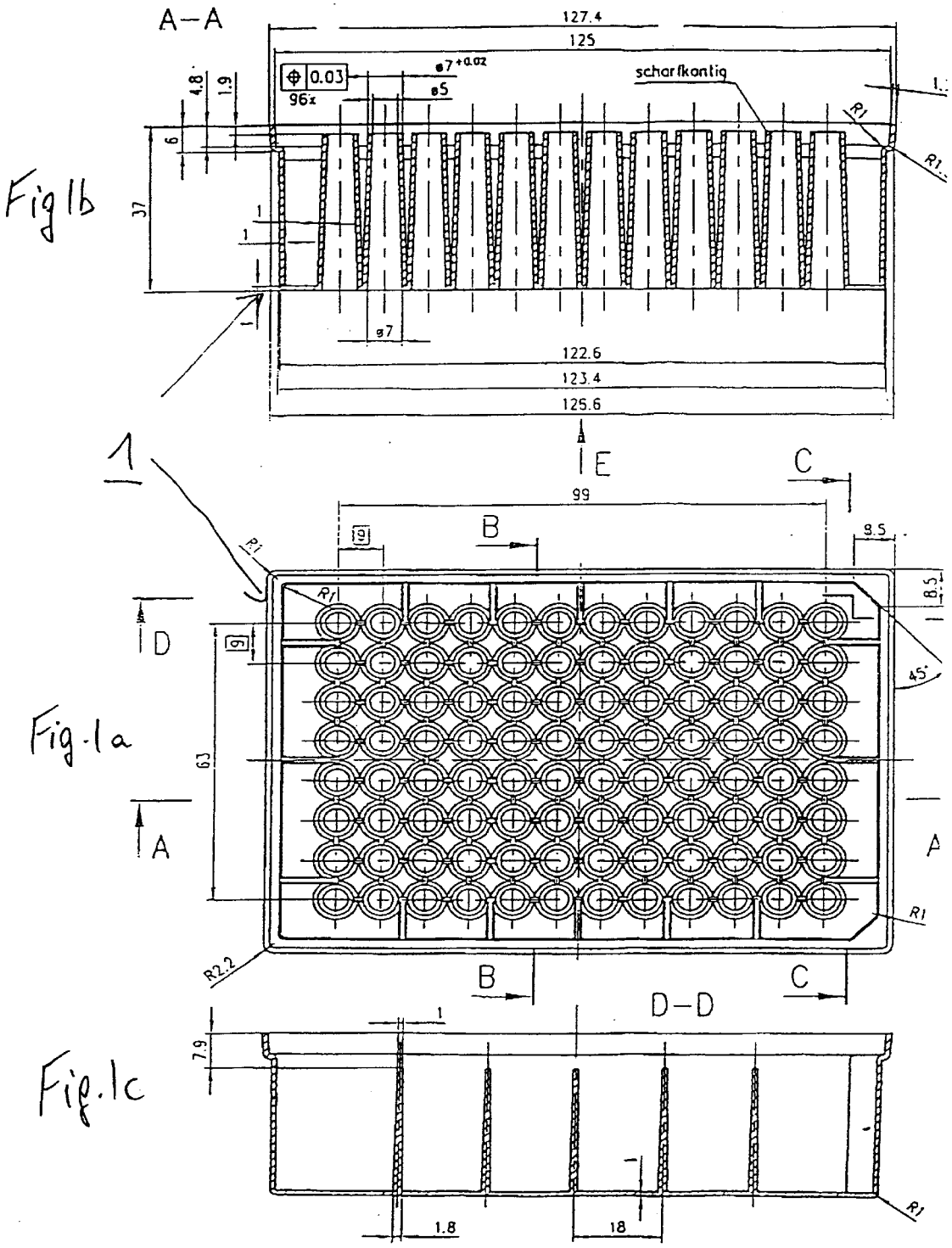
FIG. 1*a* is a plan view of the sample holder of a multiwell filtration plate according to the present invention.
FIG. 1*b* is a cross sectional view taken along the line A—A of FIG. 1*a;*
FIG. 1*c* is a cross sectional view taken along the line D—D of FIG. 1*a;*
Figure 2A:
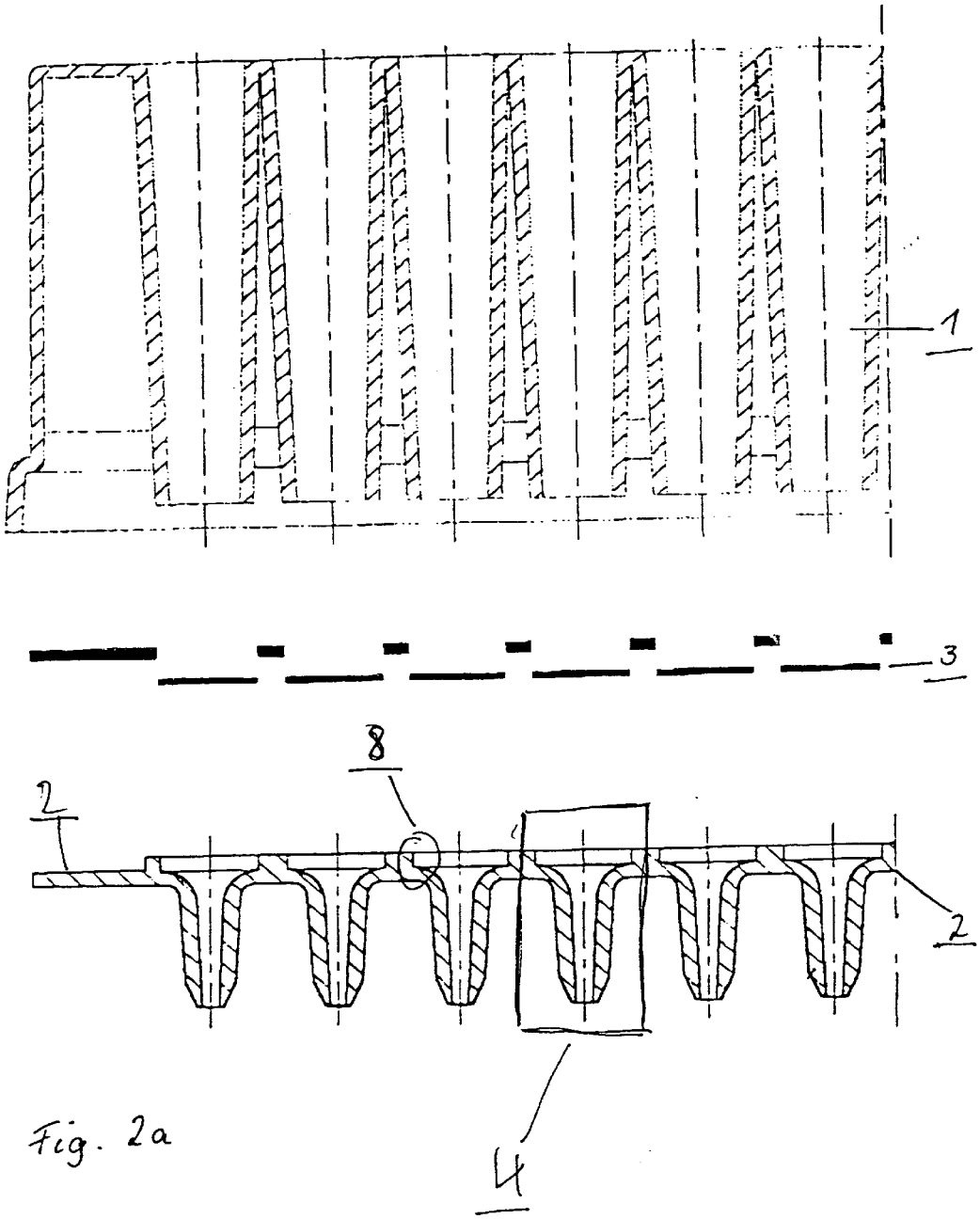
FIG. 2*a* shows a longitudinal cross sectional view of the sample holder, the filter insert and the outlet part.
Figure 2B:
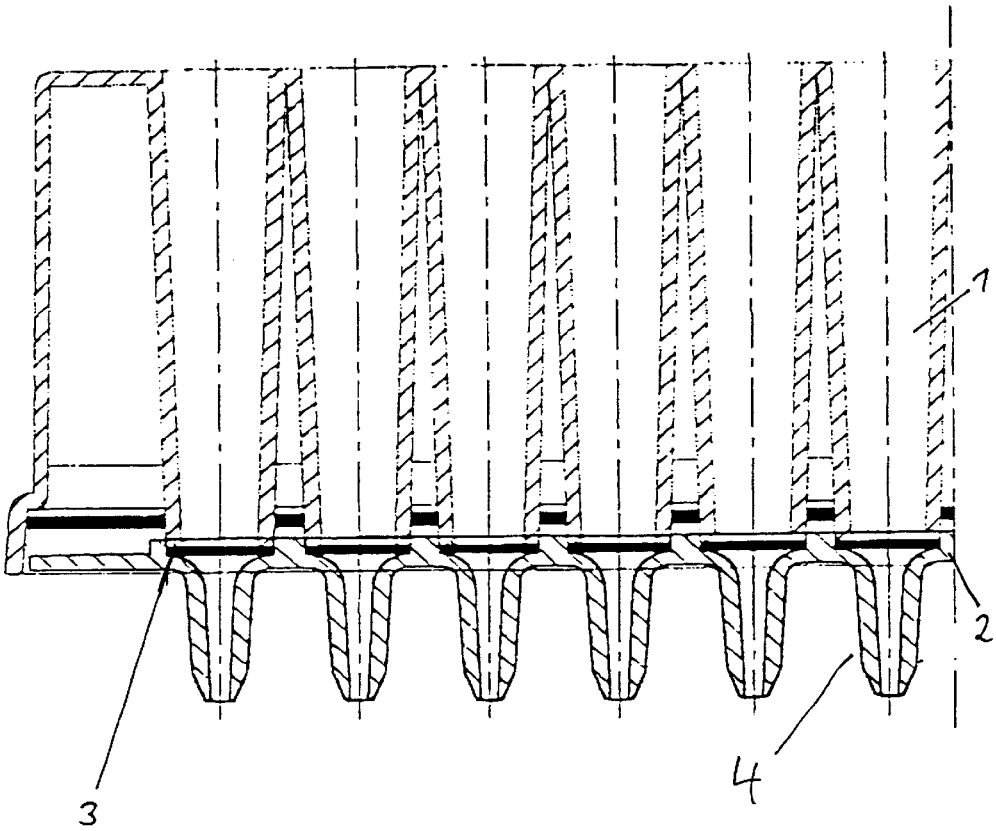
FIG. 2*b* shows the assembly of the multiwell filtration pate in a longitudinal cross sectional view.
Figure 3:
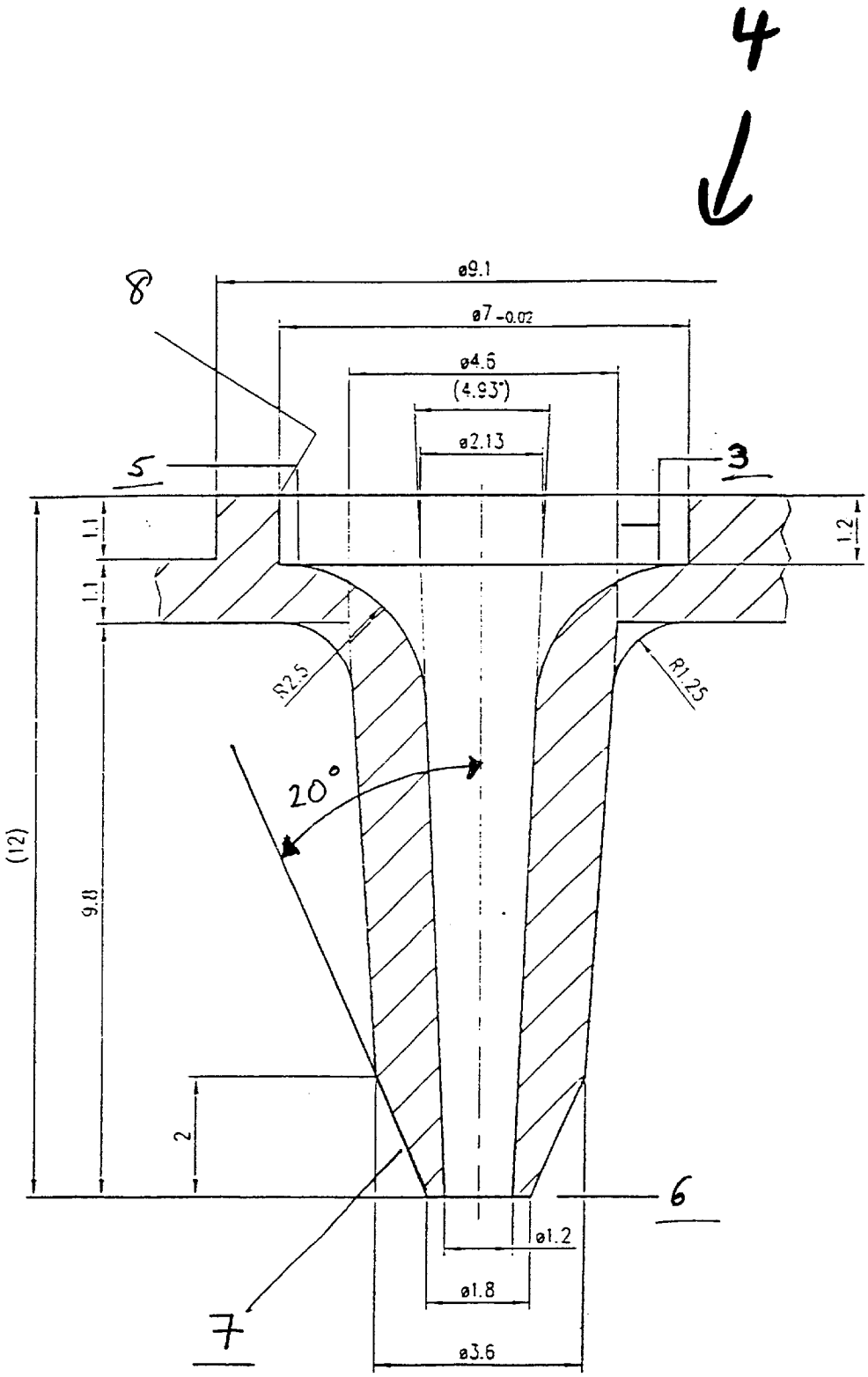
FIG. 3 shows a transverse cross sectional view of an outlet connecting piece.

As shown in FIG. 2*b*, the upper part of the plate is defined as the sample holder 1 and the lower part of the plate as the outlet part 2 with a filter 3. For each well, the outlet part 2 has an outlet connecting piece 4, which are formed in accordance with the invention and over which the filtrate runs into a collecting vessel, such as a deep well plate, for further determinations. Essentially, the outlet part 2 is characterized by a specially shaped edge 8 at an outlet connecting piece 4, of which there are 96 or 384, depending on the size and objective of the plate. These outlet connecting pieces 4 have an internal angle of inclination 7 of 20° as shown in FIG. 3 and, at the site of connection with the upper part, there is a supporting shoulder (sealing shoulder) 5, which stabilizes the filter insert 3 and is from about 1.0 to about 1.5 mm and suitably 1.0 mm thick. Their length is from about 10 to about 15 mm, and suitably 12 mm. The filtration plate is optionally coupled to the outlet vessel.

The outlet connecting pieces 4 usually are round. In an alternate embodiment, the outlet connecting pieces 4 can have a star-shaped cross section at their outlet end or overall with at least 8 openings. The internal angle of inclination of 20° and the particular outlet design enable the filtered sample to run out completely and without problems into the collection vessel, such as the deep well plate.

Highly problematic cross contamination can be avoided by the length of the outlet connecting piece 4 of, for example, 12 mm. Known microtiter plates have outlets with only a maximum length of 9 mm.

The multiwell filtration plate of the present invention is also useful for applications in PCR-based infection diagnosis. As a result of the longer outlet connecting pieces 4, the filtration plates of the present invention have a larger accommodating capacity than the previously known filtration plates, with a chamber capacity of more than 1 ml, that is, sample volumes larger than those previously customary can be processed. This also leads to more reproducible results.

In preparing the novel multiwell filtration plate of the present invention, both parts of the multiwell filtration plate are firmly connected together in a production run by using hydraulic compression. The compression takes place in each case at the depressions with the suitably 96 or 384 outlet connecting pieces 4. In the mold the internal compressing edges are sharpened so that, during the compression, for which the filter insert 3, such as a filter sheet or mat, is placed between the upper part 1 and the lower part 2, and filter inserts are punched out cleanly corresponding to the depressions. These punched-out filter inserts are pressed with the upper part into the lower part and are placed on the supporting shoulder 5 in the lower part 2. The upper part of the plate, the filter platelet and the lower part of the plate are firmly and tightly pressed together by hydraulic pressure. Such a compression becomes possible according to the invention because the lower part and the upper part of the new multiwell filtration plates are manufactured in two precision molds by the hot channel technique in which molds are matched precisely to one another, with a maximum tolerance of 1/1000 mm. Sharp cutting edges at the compression parts of the two plate parts enable individual filters to be punched out from a filter plate in one processing step together with the actual compression.

The multiwell filtration plate is suitably produced by injection molding with carefully adjusted injection molding parameters. The filtration plates of the present invention are made of known materials, such as polystyrene or polypropylene. The injection molding material used is suitably is a high-grade polystyrene.

Since only accurately fitting injection molded parts are used, the pressing takes place without sealing lips or gaskets. The present invention solves all existing problems in an ideal manner. The plate is prepared by a new method which highly efficiently and cost effectively enables a filtration material to be introduced into the multiwell filtration plate. Furthermore, the novel multiwell filtration plate is dimensioned so that previously encountered cross contaminations can be eliminated by the shape of the outlet connecting piece 4. External dimensions (width and length) of the plate and the arrangement of the depressions (suitably in an 8×12 matrix) correspond to those of normal microtitration plates. A further advantage is the increase in the capacity of the reaction cavities to about 1 ml. That enables realization of all standard applications of the automated isolation and purification of nucleic acids without problems with one plate.

What is claimed is:

1. A multiwell filtration plate which comprises a sample holder having a plurality of openings for holding a sample to be filtered;

an outlet part adjacent to said sample holder part for receiving said sample from said sample holder part, said outlet part comprising a plurality of outlet connecting pieces aligned and permanently joint with said openings of said sample holder part without sealing components, each of said outlet connecting pieces comprising:

a first inner bore corresponding to an opening of said sample holder part:

a second inner bore defining a lumen within said outlet connecting piece and having a diameter smaller than said first inner bore;

a supporting shoulder connecting said first and second inner bores for supporting a filter insert:

a filter insert supported by said supporting shoulder: and an outlet end;

wherein said outlet connecting piece has a length of at least about 10 mm and an internal angle of inclination of about 20°.

2. The multiwell filtration plate of claim 1, wherein each outlet connecting piece has a round or star-shaped outlet end.

3. The multiwell filtration plate of claim 2, wherein said star-shaped outlet end has, 8 openings.

4. The multiwell filtration plate of claim 1, wherein each outlet connecting piece has a length from 10 to 15 mm.

5. The multiwell filtration plate of claim 4, wherein each outlet connecting piece is at least 12 mm long.

* * * * *